US010898945B2

(12) United States Patent
Pijanowski et al.

(10) Patent No.: US 10,898,945 B2
(45) Date of Patent: Jan. 26, 2021

(54) HIGH-PRESSURE SEAMLESS STEEL CYLINDER WITH SECOND INNER NECK AND THE METHOD OF ITS PRODUCTION

(71) Applicant: VITKOVICE CYLINDERS a.s., Ostrava-Vitkovice (CZ)

(72) Inventors: Tomas Pijanowski, Ostrava-Hrabuvka (CZ); Pavel Kucera, Frydlant nad Ostravici (CZ); Petr Hofrik, Ostrava-Poruba (CZ)

(73) Assignee: VITKOVICE CYLINDERS a.s., Vitkovice (CZ)

( * ) Notice: Subject to any disclaimer, the term of this patent is extended or adjusted under 35 U.S.C. 154(b) by 189 days.

(21) Appl. No.: 15/753,999

(22) PCT Filed: Aug. 21, 2015

(86) PCT No.: PCT/CZ2015/000094
§ 371 (c)(1),
(2) Date: Feb. 21, 2018

(87) PCT Pub. No.: WO2017/032348
PCT Pub. Date: Mar. 2, 2017

(65) Prior Publication Data

US 2018/0243820 A1 Aug. 30, 2018

(51) Int. Cl.
*B21K 21/06* (2006.01)
*B21K 21/14* (2006.01)
*F17C 1/14* (2006.01)

(52) U.S. Cl.
CPC ..... *B21K 21/06* (2013.01); *B21K 21/14* (2013.01); *F17C 1/14* (2013.01);
(Continued)

(58) Field of Classification Search
CPC . B21K 21/06; B21K 21/14; F17C 1/14; F17C 2201/0104; F17C 2201/056;
(Continued)

(56) References Cited

U.S. PATENT DOCUMENTS 4,023,701 A 5/1977 Dockery ..... 220/64
4,829,950 A 5/1989 Kanamaru et al. ..... 123/90.51
5,758,415 A * 6/1998 Hara ..... F01L 1/143 123/90.51

FOREIGN PATENT DOCUMENTS

CZ 243247 B1 11/1987
CZ 252113 B1 5/1988
(Continued)

OTHER PUBLICATIONS

International Search Report dated Apr. 21, 2016 in corresponding PCT International Application No. PCT/CL2015/000094.
(Continued)

*Primary Examiner* — Teresa M Ekiert
(74) *Attorney, Agent, or Firm* — Ostrolenk Faber LLP

(57) ABSTRACT

A method of producing a high-pressure steel cylinder by forming from an individual dimension piece, consisting of an upper neck on the rounded end, which protrudes from the cylinder and it is provided by an opening the cylinder is additionally provided on its bottom with another bottom neck made in an inner material strengthening which is orientated insidewards of the high-pressure steel cylinder and the inner material strengthening is provided by a through-out opening.

1 Claim, 3 Drawing Sheets

(52) U.S. Cl.
CPC *F17C 2201/0104* (2013.01); *F17C 2201/056* (2013.01); *F17C 2203/0617* (2013.01); *F17C 2203/0639* (2013.01); *F17C 2205/0397* (2013.01); *F17C 2209/2181* (2013.01)

(58) Field of Classification Search
CPC ..... F17C 2203/0617; F17C 2205/0397; F17C 2209/2181; B21D 51/2615; B21D 51/2638; B21D 22/20; B21D 35/008; B21C 1/006; B21J 5/006; B06B 3/00
USPC ..... 72/348
See application file for complete search history.

(56) References Cited

FOREIGN PATENT DOCUMENTS

| | | | |
|---|---|---|---|
| CZ | 20492 | U1 | 2/2010 |
| DE | 10 2010 053 634 | A1 | 6/2012 |

OTHER PUBLICATIONS

Written Opinion dated Apr. 21, 2016 in corresponding PCT International Application No. PCT/CZ2015/000094.

* cited by examiner

HIGH-PRESSURE SEAMLESS STEEL CYLINDER WITH SECOND INNER NECK AND THE METHOD OF ITS PRODUCTION

CROSS-REFERENCE TO RELATED APPLICATIONS

The present application is a 35 U.S.C. §§ 371 national phase conversion of PCT/CZ2015/000094, filed Aug. 21, 2015, the content of which are incorporated herein by reference. The PCT International Application was published in the Czech language.

BACKGROUND OF THE INVENTION

The invention concerns a high-pressure seamless steel cylinders for compressed gases with inner shaped neck, made by backwards extrusion and broaching method.

STATE OF THE ART

The high-pressure steel cylinders 1', which are illustrated in FIG. 1, are in the applicant's company made by methods of backwards extrusion followed by broaching. The process of production consists at first of division (cutting) of individual dimension pieces from square or rounded crowbars. Steel dimension pieces are heated in the induction furnace up to the temperature of 1100-1250° C. before forming. Before pressing, individual dimension pieces must always go through high-pressure splashing of iron scales. Than the process of backwards extrusion follows.

This process is realized on a vertical punching press. The process of backwards extrusion takes place in several basic steps.

The first step is the positioning (insertion) of heated dimension piece on the bottom of the die. This bottom of the die is placed onto a moveable piston, which is moving vertically in a cylindrical insert of the die. The bottom of the die and the cylindrical insert form a resistant wall against a stream of material during the backwards extrusion process.

The second step is placing of the piston with the holder of the bottom of the die into the basic pressing position (according to the produced sortiment). Than the entering of pressing (punching) mandrel into the cylindrical die follows, on its bottom the hot dimension piece is situated on the "die bottom". The unillustrated pressing respective punching mandrel is on its ending provided with a flat punching head 17, illustrated in FIG. 2.

During this step, the primary thick-wall hollow semi-finished blank is created, from which subsequently the pressing mandrel is driven out. This punched (extruded) semi-finished blank is smooth inside, without protrusions or bumps etc. The complete process is described in the document CZ 243247 B1 and also in the document CZ 252113 B1. The bottom of the cylinder is pressed practically on final thickness, nevertheless the inner diameter of the flat punching head 17 and also the inner diameter of cylindrical die are bigger then final sizes of the cylinder. The flat punching head 17 is in the first operation a separate ending part, which is than fixed on the end of an unillustrated mandrel.

After the backwards extrusion of the hollow semi-finished blank this semi-finished blank is robotically taken away and seated into the broaching horizontal press, where the second forming operation takes place, and this is backwards extrusion. The forming proceeds so, that the semi-finished blank from the first forming operation is placed on the pressing mandrel with already final inner diameter of the cylinder.

For reaching of the final inner diameter the semi-finished blank is pushed through scraper ring (reshaping of the thickness of the wall about 25% and cleaning of a iron scales) and eight roller sets provided by reduction rollers. The semi-finished blank is rolled and reshaped on the mandrel for required inner and outer diameter. After passage of the semi-finished blank through the roller sets the whole operation is finished by pushing of the bottom of the future cylinder into the calibration die where the final shape of the bottom of the cylinder is formed. During the backwards motion of the mandrel, the semi-finished blank of the cylinder is drawn off with scraper jaws from pressing mandrel. This technology is described in CZ 20492 U1.

The cylindrical hollow semi-finished blanks made by this way are chilled by the air and than the neck is closed using the rotation forming. By this way the steel cylinder of typical geometry is produced, see FIG. 1.

The customers are often looking for the two neck steel cylinders for different reasons. The presentation of such type of cylinders is in FIG. 3, where such steel cylinder according to the state of art is illustrated. By this way constructed type of cylinders enable the application of different types of valves, connection (pipening) on both sides of cylinders. Nowadays it can be reached only with cylinders, which are made of tubes, using the rotation forming technology. Here both ends are closed with use of the rotation forming of a tube 15, what is illustrated in FIG. 3 or with excessive thickness of convex/concave bottom.

Disadvantage of this cylinders is relatively high coefficient resulting from the ratio of volume/weight. For this variant its also necessary to have at disposal larger storage place, or transport place regarding the length because it is always necessary to have specific length of necks of the cylinder on both sides The aim of the invention is to present a both sides open high-pressure steel cylinders made by use of the same process of forming as in the known one side open high-pressure steel cylinder and the methods of its production.

SUMMARY OF THE INVENTION

The above mentioned drawbacks are eliminated by the high-pressure seamless steel cylinder with second inner neck according to this invention, which principles consists especially in that it is additionally provided on its bottom with another bottom neck made in an inner material strenghtening which is orientated insidewards of the high-pressure steel cylinder and the inner material strenghtening is provided by a through-out opening.

Another feature of the invention the method of production of seamless high-pressure steel cylinder which principles consists especially in that on the outer surface of the shaped punching head a cavity for creating of the inner material stranghtening of the bottom of the high-pressure steel cylinder is created and the backwards extrusion using such modified shaped punching head is done, afterwords in the subsequent step the backwards extrusion process with monolitic pressing mandrel is done, the mandrel is provided by the shaped end provided with the cavity, wherein the rest of the high-pressure steel cylinder is made by the known method and in the end the inner material strenghtening on the bottom of the high-pressure steel cylinder is drilled through and so the through-out bottom neck is created.

DESCRIPTION OF THE DRAWINGS

The invention will be explained by use of drawings, where.

PREFERRED EMBODIMENTS OF THE INVENTION

Figure 4:
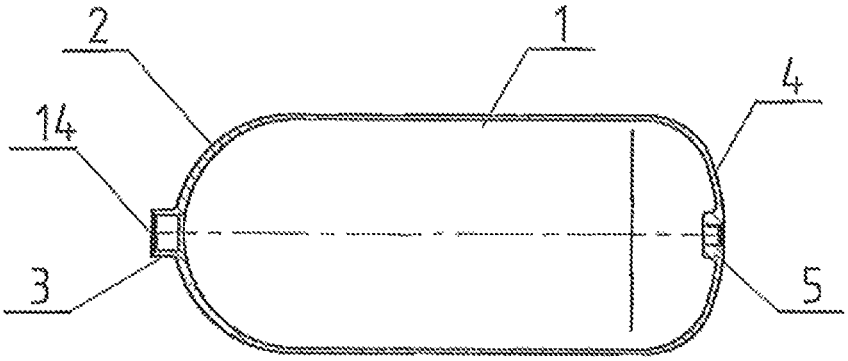
FIG. 4 presents the steel cylinder according to the invention.

In FIG. 4 the high-pressure steel cylinder 1 according to the invention is presented. It consists of an upper part 2 with an upper neck 3 of already known embodiment and further of inovatively made bottom part 4 with a bottom neck 5, which is completely over the level of lower surface of the bottom part 4.

Figure 5:
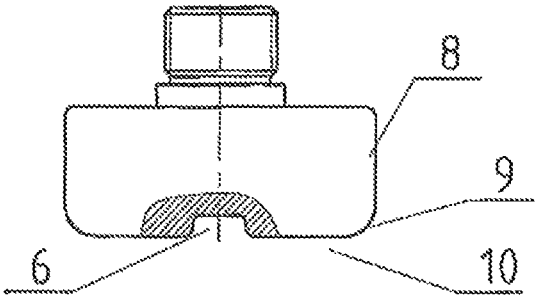
FIG. 5 presents a shaped punching head according to the invention for production of the steel cylinder according to FIG. 4.

In FIG. 5 a shaped punching head 8 according to the invention is presented, which is like by the method according to the state of the art an individual part and it is placed on the end of an unillustrated pressing mandrel. In the first forming operation a thick-wall semi-finished blank is produced—see FIG. 6. The shaped punching head 8 has again a little bit bigger outer diameter and the die 16 a little bit bigger inner diameter, so the bottom of the cylinder is pressed practically on final thickness, nevertheless the wall of the pressed semi-finished blank is more thick than the final thickness—that is good to see in FIG. 6, where there is the different thickness of the bottom—practically the final thickness—and of the walls. The face 9 of the shaped punching head 8 according to the invention is on its outer surface 10 provided with a cavity 6. This is advantageously made as cylindrical and it is in the axis of the shaped punching head 8. It is obvious, that into this cavity 6 the material flows and an inner material strenghtening 11 of the bottom 12 is created.

Figure 6:
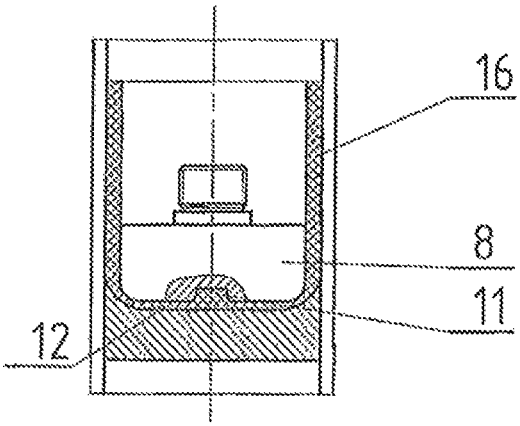
FIG. 6 presents the first operation of forming of the steel cylinder according to FIG. 4 with the shaped punching head according to FIG. 5.

It is good to see in FIG. 6, where the shaped punching head 8 is placed on an here unillustrated punching mandrel during the process of the backward extrusion.

Figure 7:
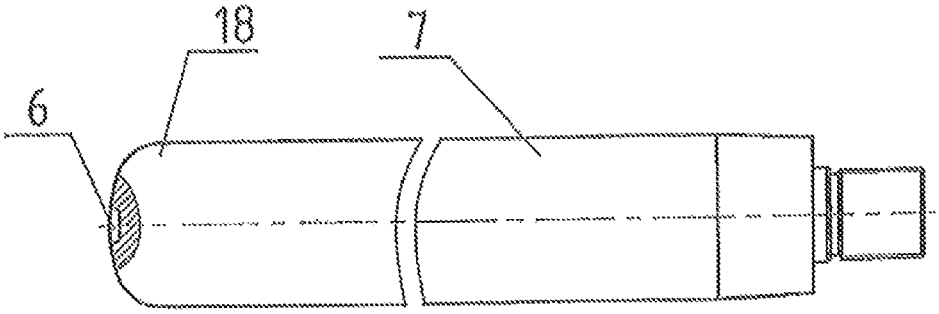
FIG. 7 is a view on monolitic pressing mandrel with shaped end of the same shape of the bottom as by the forming punching head from FIG. 5.

In FIG. 7 there is a view on a whole monolitic pressing madrel 7, which is on its face provided with shaped end 18 with the cavity 6, but they create together one piece.

Figure 8:
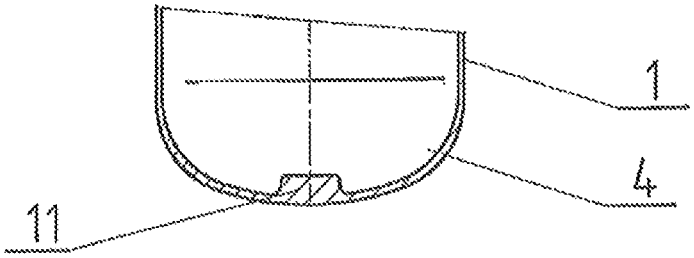
FIG. 8 presents a semi-finished blank after realization of operation from FIG. 6

In FIG. 8 the final shape of the bottom part 4 of the high-pressure steel cylinder 1 after its drawing off from last broaching set can be seen. The bottom part 4 is provided with inner material strenghtening 11.

Figure 9:
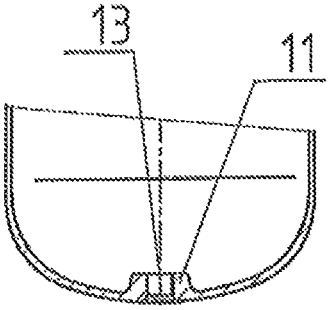
FIG. 9 presents an another step of production of the second neck by the steel cylinder from FIG. 4.

In FIG. 9 it is seen, that through this inner material strenghtening 11 in the end a through-out opening 13 is drilled and into it a valve or a screw joint like into the opening 14 in the upper neck 3.

Such high-pressure steel cylinder 1 is made by the following way according to the invention:

It is made by backward extrusion and broaching method. The forming of the bottom neck 5 is realized already during the first step—backwards extrusion by the shaped punching head 8 placed on the pressing mandrel. How it is mentioned above, the shaped punching head 8 has a little bit bigger outer diameter and the die 16 has a little bit bigger inner diameter, so the bottom of the cylinder is pressed practically on its final thickness, nevertheless the thickness of the semi-finished blank is more thick than the final thickness of the cylinder.

With use of the especially modified shaped punching head 8 with the cavity 6 the material is flowing during the forming process into the empty cavity 6 in the shaped punching head 8.

Figure 1:
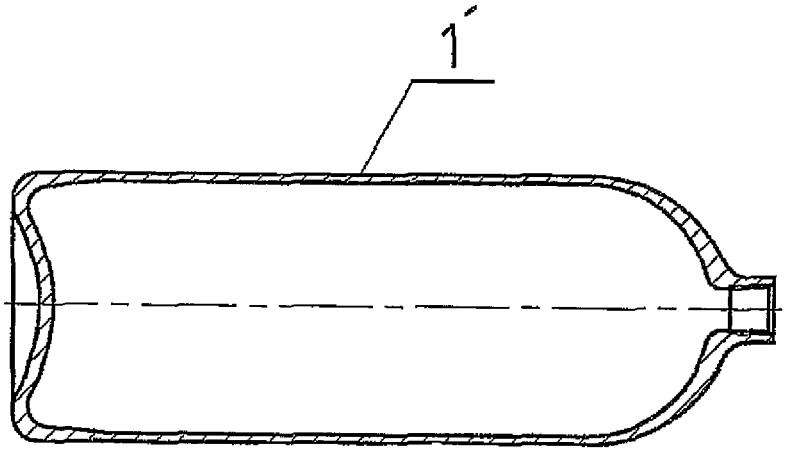
FIG. 1 is a view on the one-side open steel cylinder with one neck made by forming according to the state of art.
Figure 2:
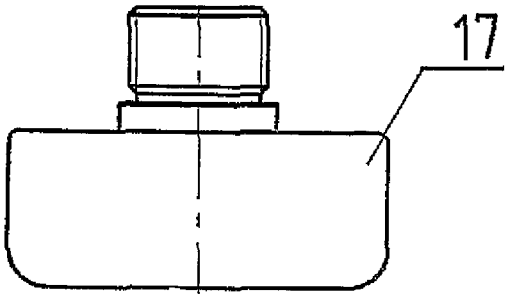
FIG. 2 is a view on the flat forming punching head according to the state of art to production of the cylinders according to FIG. 1.

Next step is the backwards extrusion process on the modified pressing mandrel 7, which is provided with the shaped end 18 with the cavity 6, but it is made as only one piece. That is seen in FIG. 7 where by use of the monolitic pressing mandrel 7 with the shaped end 18, calibration of geometry of the bottom 12 is done. Afterwards the final calibration of sizes of the second neck is done, as illustrated in FIG. 1 or 3.

Subsequently, the inner material strenghtening 11 in the bottom 12 of the high-pressure steel cylinder 1 is drilled through and the through-out opening 13 is created.

Figure 3:
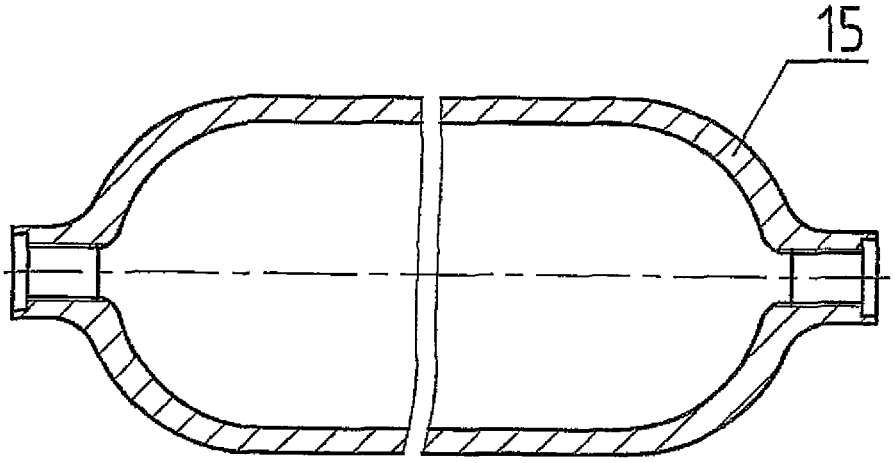
FIG. 3 is a view on both-side open steel cylinder made of tube using the rotation forming technology.

Due with this way produced steel cylinder the total size of known double neck steel cylinder illustrated in FIG. 3 gets shorter, although the whole volume is kept, not regarding, that the forming technology from individual dimension pieces is substantially easier than the forming technology of steel tubes and also the needed space for transport gets shorter in size and integrity of the steel cylinder is greater, the distribution of strength within the cylinder is lowered, simultaneously there is no lowering of any use parameters or mechanical characteristics etc.

For realization of the production of the high-pressure steel cylinders according to the invention is necessary only to adjust the geometry of the face of the shaped punching head, when in the center of the face of the shaped punching head make the cavity is made, where the material during the backward extrusion process can flow. Another tool, which is necessary to adjust for production of this new type of cylinders is the monolitic pressing mandrel, on its face it is necessary to create a shaped end with the similar cavity as in case of punching head from the first operation as it is seen in FIG. 7. Other forming tools can stay without geometrical changes. The final process of forming continues in the same way as in the case of production of common high-pressure steel cylinders, as it is described above.

This type of steel cylinder is unique regarding of broadening of user's attributes because of inner necks—it is possible to increase water volume by keeping the same total length of steel cylinders even with valves.

The invention claimed is:

1. A method of production of a seamless, high-pressure steel cylinder with an inner diameter and an outer diameter, the method comprising:

providing a shaped punching head and a die, the shaped punching head having a smaller outer diameter than an inner diameter of the die, the shaped punching die having a larger outer diameter than the inner diameter of the steel cylinder, and the die having an inner diameter larger than the outer diameter of the steel cylinder, and the shaped punching head having a bottom face with a cavity therein;

providing a steel blank;

pressing the shaped punching head against the steel blank while the steel blank is in the die to form a first end of the steel cylinder having a thickened portion received in the cavity of the shaped punching head to strengthen the first end of the steel cylinder, the pressing resulting in a semi-finished steel cylinder;

after the pressing, broaching the semi-finished steel cylinder with a monolithic pressing mandrel, the monolithic pressing mandrel having a shaped end to form a final shape of the first end of the steel cylinder, and having a cavity that can receive the thickened portion;

forming a second end of the steel cylinder opposite the first end; and drilling through the thickened portion to create a neck at the first end.

* * * * *